US006443662B1

(12) United States Patent
Scales et al.

(10) Patent No.: US 6,443,662 B1
(45) Date of Patent: Sep. 3, 2002

(54) CONNECTOR FOR ENGAGING SOIL-REINFORCING GRID TO AN EARTH RETAINING WALL AND METHOD FOR SAME

(75) Inventors: John M. Scales, Norcross; Zehong Yuan, Duluth, both of GA (US)

(73) Assignee: Geostar Corporation, Norcross, GA (US)

( * ) Notice: Subject to any disclaimer, the term of this patent is extended or adjusted under 35 U.S.C. 154(b) by 0 days.

(21) Appl. No.: 09/698,003

(22) Filed: Oct. 25, 2000

(51) Int. Cl.[7] ..... E02D 29/02
(52) U.S. Cl. ..... 405/262; 405/284; 405/286
(58) Field of Search ..... 405/262, 284, 405/285, 286

(56) References Cited

U.S. PATENT DOCUMENTS

| | | | | |
|---|---|---|---|---|
| 3,383,864 A | | 5/1968 | Turzillo | 405/18 |
| 3,686,873 A | | 8/1972 | Vidal | 405/262 |
| 4,116,010 A | | 9/1978 | Vidal | 405/262 |
| 4,324,508 A | | 4/1982 | Hilfiker et al. | 405/284 |
| 4,448,571 A | | 5/1984 | Eckels | 405/284 |
| 4,661,023 A | | 4/1987 | Hilfiker | 405/262 |
| 4,710,062 A | | 12/1987 | Vidal et al. | 405/262 |
| 4,804,299 A | | 2/1989 | Forte et al. | 405/285 |
| 4,824,293 A | | 4/1989 | Brown et al. | 405/284 |
| 4,914,876 A | | 4/1990 | Forsberg | 52/169.4 |
| 5,028,172 A | | 7/1991 | Wilson et al. | 405/286 |
| 5,033,912 A | | 7/1991 | Vidal | 405/262 |
| 5,091,247 A | | 2/1992 | Willibey et al. | 428/255 |
| 5,131,791 A | | 7/1992 | Kitziller | 405/286 |
| 5,145,288 A | | 9/1992 | Borcherdt | 405/284 |
| 5,156,496 A | | 10/1992 | Vidal et al. | 405/262 |
| 5,163,261 A | | 11/1992 | O'Neill | 52/610 |
| 5,277,520 A | | 1/1994 | Travis | 405/128 |
| 5,417,523 A | | 5/1995 | Scales | 405/284 |
| 5,419,092 A | | 5/1995 | Jaecklin | 52/562 |
| 5,595,460 A | * | 1/1997 | Miller et al. | 405/284 |
| 5,788,420 A | * | 8/1998 | Scales | 405/262 |
| 5,800,095 A | | 9/1998 | Egan | 405/262 |
| 5,800,097 A | * | 9/1998 | Martin | 405/284 |
| 5,816,749 A | * | 10/1998 | Bailey, II | 405/286 |
| 6,019,550 A | * | 2/2000 | Wrigley et al. | 405/262 |
| 6,224,295 B1 | * | 5/2001 | Price et al. | 405/262 |

OTHER PUBLICATIONS

Designing with Geosynthetics, Koerner, Robert M., Prentice–Hall, Inc., Englewood Cliffs, NJ 07632, 3rd ed.—pp. 37–42;192–199; 328–351.

Safe slope reinforcement and stable embankment construction (undated).

* cited by examiner

*Primary Examiner*—Heather Shackelford
*Assistant Examiner*—Frederick L. Lagman
(74) *Attorney, Agent, or Firm*—Baker, Donelson, Bearman & Caldwell

(57) ABSTRACT

A connector for joining a soil-reinforcement grid extending through a slot in a block stacked with other blocks to define a mechanically stabilized earth retaining wall, the connector comprising matingly engaged first member having pins that are slidingly received in aligned openings defined in a second member while sandwiching a portion of soil-reinforcement grid therebetween, the grid having apertures through which the pins extend. The soil-reinforcing grid is loaded by being covered with backfill materials. The connector mechanically engages bearing surfaces within a channel in the block such that the tensile loading of backfill covering the soil-reinforcement grid lateral of the wall is distributed by the connector across the block. A method of constructing a mechanically stabilized earth retaining wall is disclosed as well as a connector and blocks useful with such methods and walls.

32 Claims, 4 Drawing Sheets

CONNECTOR FOR ENGAGING SOIL-REINFORCING GRID TO AN EARTH RETAINING WALL AND METHOD FOR SAME

TECHNICAL FIELD

The present invention relates to earth retaining walls. More particularly, the present invention relates to connectors used in mechanically stabilized earth retaining walls to join laterally extending soil reinforcement sheets to blocks in the earth retaining wall whereby the tensile loading imposed by backfill on the soil reinforcement sheets is transferred to the earth retaining wall.

BACKGROUND OF THE INVENTION

Mechanically stabilized earth retaining walls are construction devices used to reinforce earthen slopes, particularly where changes in elevations occur rapidly, for example, development sites with steeply rising embankments. These embankments must be secured, such as by retaining walls, against collapse or failure to protect persons and property from possible injury or damage caused by the slippage or sliding of the earthen slope.

Many designs for earth retaining walls exist today. Wall designs must account for lateral earth and water pressures, the weight of the wall, temperature and shrinkage effects, and earthquake loads. The design type known as mechanically stabilized earth retaining walls employ either metallic or polymeric tensile reinforcements in the soil mass. The tensile reinforcements extend laterally of the wall formed of a plurality of modular facing units, typically precast concrete members, blocks, or panels, stacked together. The tensile reinforcements connect the soil mass to the blocks that define the wall. The blocks create a visual vertical facing for the reinforced soil mass.

The polymeric tensile reinforcements typically used are elongated lattice-like structures often referred to as grids. These are stiff polymeric extrusions defining large sheets. The grids have elongated ribs which connect to transversely aligned bars thereby forming elongated apertures between the ribs. The modular precast concrete members may be in the form of blocks or panels that stack on top of each other to create the vertical facing of the wall.

Various connection methods are used during construction of earth retaining walls to interlock the blocks or panels with the grids. One known type of retaining wall has blocks with bores extending inwardly within the top and bottom surfaces. The bores receive dowels or pins. After a first tier of blocks has been positioned laterally along the length of the wall, the dowels are inserted into the bores of the upper surfaces of the blocks. Edge portions of the grids are placed on the tier of blocks so that each of the dowels extends through a respective one of the apertures. This connects the wall to the grid. The grid extends laterally from the blocks and is covered with back fill. A second tier of blocks is positioned with the upwardly extending dowels fitting within bores of the bottom surfaces of the blocks. The loading of backfill over the grids is distributed at the dowel-to-grid connection points. The strength of the grid-to-wall connection is generated by friction between the upper and lower block surfaces and the grid and by the linkage between the aggregate trapped by the wall and the apertures of the grid. The magnitude of these two contributing factors varies with the workmanship of the wall, normal stresses applied by the weight of the blocks above the connection, and by the quality and size of the aggregate.

Other connection devices are known. For example, my U.S. Pat. No. 5,417,523 describes a connector bar with spaced-apart keys that engage apertures in the grid that extends laterally from the wall. The connector bars are received in channels defined in the upper and lower surfaces of the blocks.

The specifications for earth retaining walls are based upon the strength of the interlocking components and the load created by the backfill. Once the desired wall height and type of ground conditions are known, the number of grids, the vertical spacing between adjacent grids, and lateral positioning of the grids is determined, dependent upon the load capacity of the interlocking components.

Heretofore, construction of such mechanically stabilized earth retaining walls has been limited to large high rise walls. This is due in part the need to have sufficient mass of blocks vertically higher in the wall for securing the soil reinforcement grids to the wall. However, there are numerous small scale projects which could benefit from the use of reinforcement grids and mechanically stabilized earth retaining walls. Low height walls provide insufficient normal loading by the mass of the wall above the grid connections.

Accordingly, there is a need in the art for an improved connector and block for engaging soil reinforcement grids extending laterally from earth retaining walls. It is to such that the present invention is directed.

BRIEF SUMMARY OF THE INVENTION

The present invention meets the need in the art by providing a connector for being received within a channel defined in blocks stacked side by side in tiers to define an earth retaining wall and being engaged to soil reinforcing grids extending through slots from the channels outwardly of the blocks, to transfer tensile loading imposed by backfill on the soil reinforcing grids to the earth retaining wall. The connector comprises an elongate first member that matingly engages an elongate second member. The first member has a plurality of pins spaced-apart along the longitudinal length thereof. Each pin extends in a first direction from a first side of the first member. The second member has a plurality of openings spaced-apart along the longitudinal length thereof for aligning with the pins. The first member and the second member matingly connect by slidingly receiving the aligned pins within the openings while sandwiching therebetween a soil reinforcement grid having open apertures through which the pins extend. The assembled connector is received in a channel defined in blocks that form the wall, for communicating tensile loading on the soil reinforcement grid to the wall.

In another aspect, the present invention provides an earth retaining wall having at least two stacked tiers of blocks placed side by side. Each of the blocks defines a channel extending between opposing sides. The channel defines at least two adjacent bearing surfaces and an opening between the bearing surfaces to a slot extending laterally from the channel to a back side of the block. An elongate connector conforming in cross-sectional shape at least relative to the pair of adjacent bearing surfaces defined in the channel, is received within the channel. The connector comprises an elongate first member that matingly joins an elongate second member. The first member has a plurality of pins spaced-apart along the longitudinal length thereof. Each pin extends in a first direction from a first side of the first member. The second member has a plurality of openings spaced-apart along the longitudinal length thereof for aligning with the pins. A portion of a soil reinforcement grid having a plurality of apertures is sandwiched between the first and the second members and the pins extend through respective apertures. Another portion of the soil reinforcement grid extends from the slot laterally of the blocks. The connector, being engaged to the soil reinforcement grid and received in the channel with the soil reinforcement grid extending through the slot laterally away from the blocks and the extended portion thereof loaded by backfill, mechanically engages the bearing surfaces of the channel to distribute the tensile loading across the wall.

In another aspect, the present invention provides a method of constructing an earth retaining wall, comprising the steps of:

(a) placing at least two stacked tiers of blocks side by side to define a length of a wall, each of the blocks defining a channel extending between opposing sides thereof, the channel defining at least two adjacent bearing surfaces and opening between the bearing surfaces to a slot extending laterally from the channel to a back side of the block;

(b) sandwiching a portion of a soil-reinforcement grid between an elongate first member and an elongate second member that matingly engage together to define a connector, the first member having a plurality of pins spaced-apart along the longitudinal length thereof and each pin extending in a first direction therefrom, the second member having a plurality of openings spaced-apart along the longitudinal length thereof for aligning with the pins, and the soil-reinforcement grid having a plurality of apertures defined therein for being received by the pins while sandwiched between the first and the second members;

(c) sliding the connector with the soil-reinforcement grid along the channel with a portion of the soil-reinforcement grid slidingly received within the slot and extending laterally of the wall; and (d) covering the portion of the soil-reinforcement grid lateral of the wall with backfill, whereby the connector, being engaged to the soil-reinforcement grid that is loaded by the backfill, mechanically engages the two bearing surfaces of the channel such that the tensile loading is distributed across the block.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
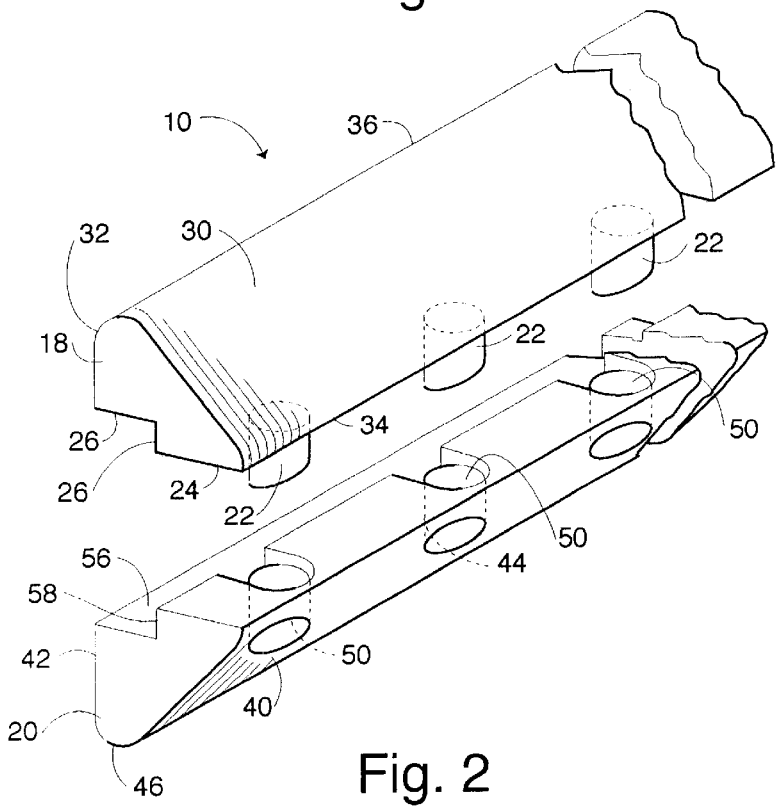
FIG. 1 illustrates an exploded perspective view of a connector for engaging open aperture soil reinforcement grids to blocks in earth retaining walls according to the present invention.
Figure 3:
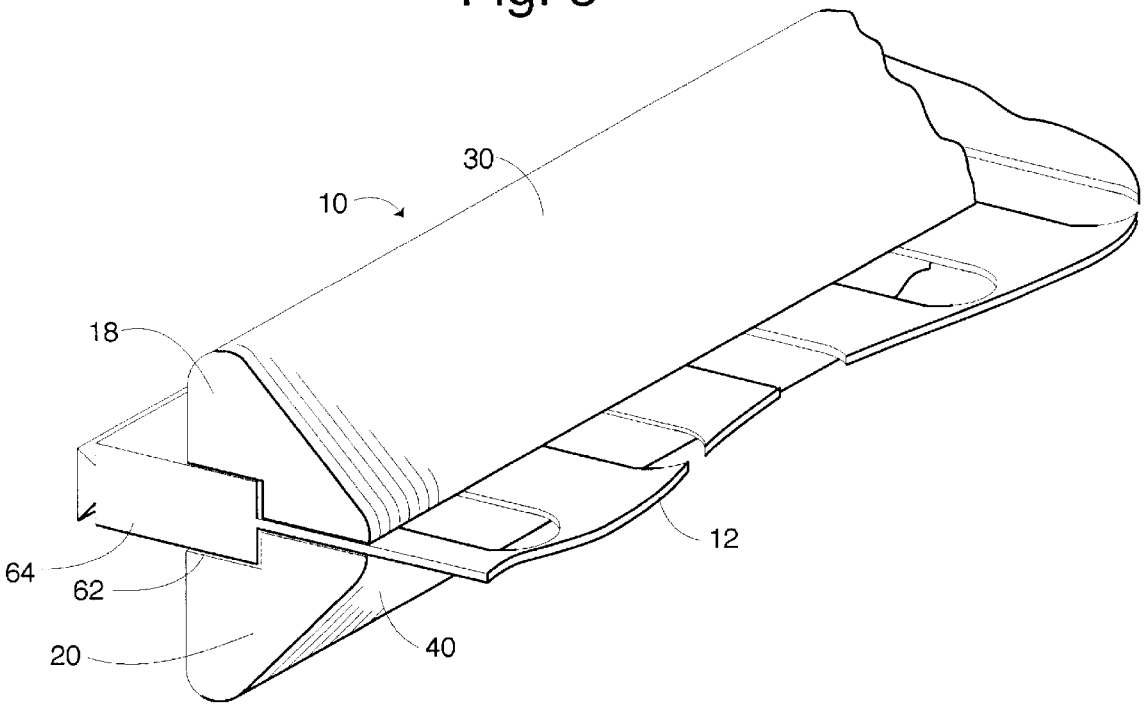
FIG. 3 illustrates in perspective view the connector in FIG. 1 engaged to an open aperture soil reinforcement grid.
Figure 4:
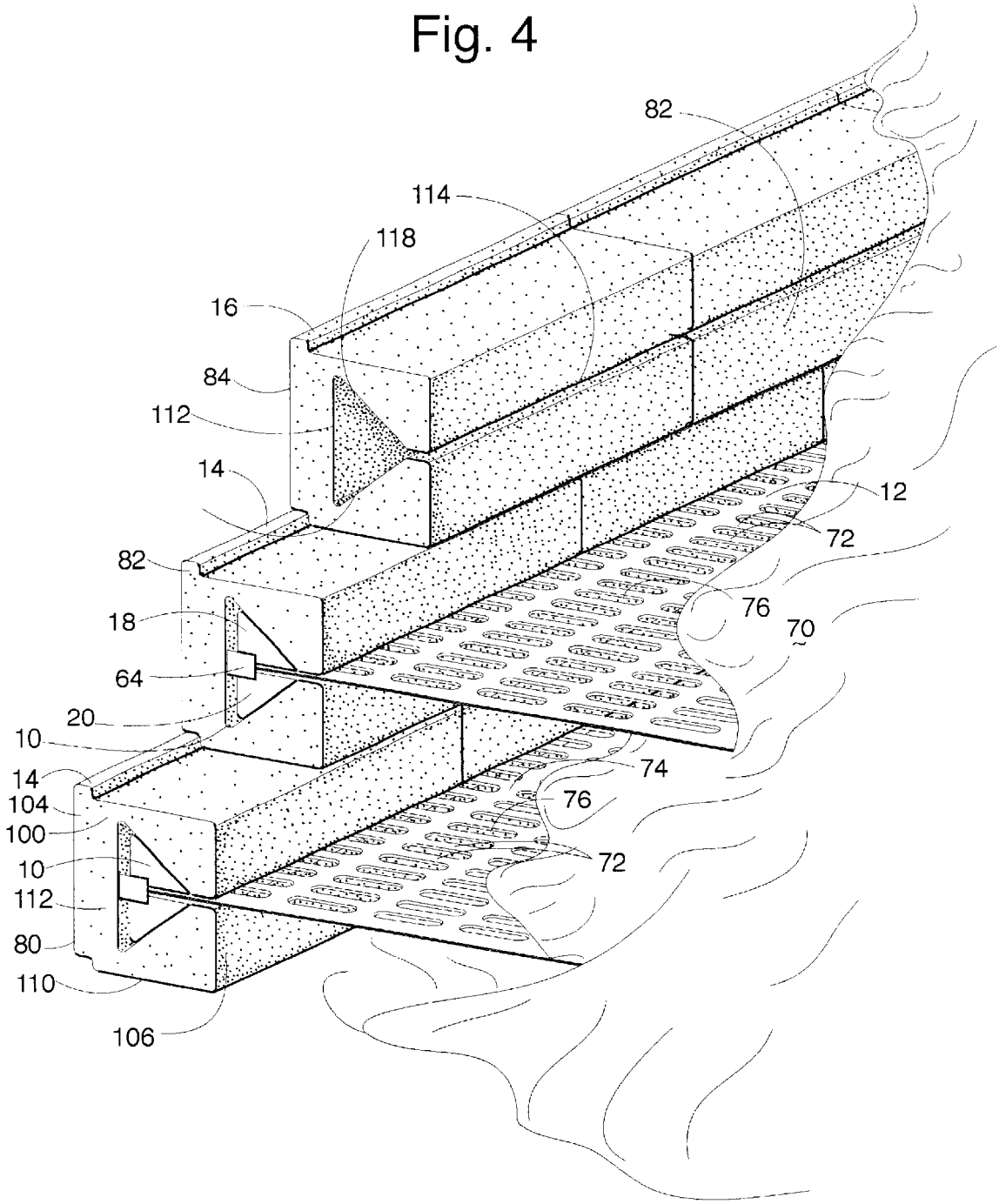
FIG. 4 illustrates a perspective view of an earth retaining wall in which the connector shown in FIG. 1 engages open aperture soil reinforcement grids for communicating the tensile loading of backfill on the open aperture soil reinforcement grids to the wall.

Referring now in more detail to the drawings in which like parts have like identifiers, FIG. 1 illustrates an exploded perspective view of a connector 10 for engaging open aperture soil reinforcement grids 12 to blocks 14 in earth retaining walls 16, according to the present invention as illustrated in FIGS. 3 and 4. The connector 10 assembles from an first member 18 that matingly engages an elongate second member 20. The first member 18 defines a plurality of pins 22 extending from a first field 24 of the first member. The pins 22 are spaced-apart along the longitudinal length of the first member 18. Each pin 22 extends in a first direction from a first side of the first member 18. The first member 18 also defines a second field 26 lateral of the pins 22 along its longitudinal length. The second field 26 is recessed relative to the first field 24. The transition between the first field 24 and the second field 26 is defined by a wall 28 which forms a stop for a purpose discussed below. The first member defines an exterior bearing surface 30, a back side 32, and a front edge 34. An edge 36 between the bearing surface 30 and the back side 32 is preferably radiused. The front edge 34 is partially radiused to define a tapered edge with the first field 24.

Figure 2:
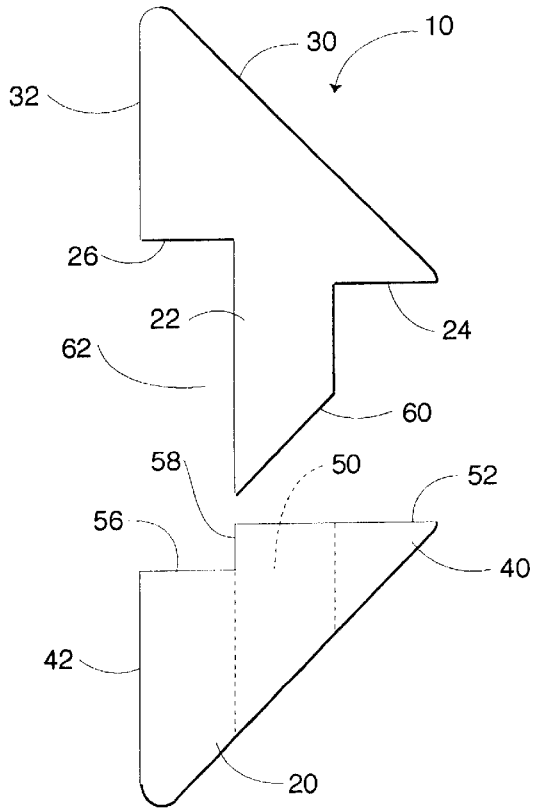
FIG. 2 illustrates a side view of the connector shown in FIG. 1.

The second member 20 likewise defines an exterior bearing surface 40, a back side 42, and a front edge 44. An edge 46 between the bearing surface 40 and the back side 42 is preferably radiused. The front edge 44 is preferably partially radiused to define a tapered portion. The second member 20 defines a plurality of openings 50 extending from a first field 52. The openings 50 are spaced-apart along the longitudinal length of the second member 20. The openings 50 align with the pins 22 of the first member 18. The second member 20 also defines a second field 56 lateral of the openings 50 along its longitudinal length. The second field 56 is recessed relative to the first field 52. The transition between the first field 52 and the second field 56 is defined by a wall 58 which forms a stop for a purpose discussed below. FIG. 2 illustrates a side view of the connector 10 shown in FIG. 1. Each pin 22 defines an oblique surface 60 at a distal end. The angle of the oblique surface conforms to the slope of the bearing surface 40 relative to the first field 52 of the second member 20. The recessed second fields 26 and 56 cooperatively define opposing walls of a channel 62 in the connector 10. As best illustrated in FIG. 3, the channel 62 receives an enlarged portion 64 of the soil reinforcement grid 12 as the first member 18 and the second member 20 matingly connect together, as discussed below.

FIG. 4 illustrates a perspective view of the earth retaining wall 16 in which connectors 10 engage open aperture soil reinforcement grids 12 for communicating the tensile loading of backfill 70 on the soil reinforcement grids to the wall. The wall 16 comprises a plurality of stacked, interconnected blocks 14 which receive the connectors 10 engaged to the soil reinforcement grids 12 in aligned channels 112 in the blocks 14. The soil reinforcement grids 12 extend laterally of the wall 16 into the backfill 70 at selected vertical intervals.

The sheet-like grid 12 is a stiff extruded planar structure formed by a network of spaced-apart members 72 which connect to spaced-apart transverse ribs 74. The connection of the members 72 to the ribs 74 define apertures 76 in the lattice-like grid 12. The apertures 76 define an open space between the adjacent members 72 and ribs 74. The apertures 76 receive soil, gravel, or other backfill materials for interlocking the grid 12 to the backfill material which is retained by the wall 16, as discussed below. In a preferred embodiment, the grid 12 is made of synthetic material, such as plastic.

The wall 16 comprises at least two tiers 80, 82 of the blocks 14. Two soil reinforcement grids 12 are illustrated extending laterally from the wall 16. The blocks 14 define a front face 84 for the wall 16. The blocks 14 in each tier 80, 82 are placed side-by-side to form the elongated retaining wall 16. Soil, gravel, or other backfill material 70 is placed on an interior side 86 of the wall 16.

Each of the blocks 14 are defined by opposing side walls 100, opposing front face 104 and back face 106, and opposing top and bottom sides 108, 110. The block 14 defines a channel 112 extending between the opposing sides 100. In a preferred embodiment, the channel 112 defines a triangular shape in cross-sectional view. In a preferred embodiment, the triangular channel 112 is substantially equilateral. The channel 112 opens to a slot 114 that extends laterally from the channel 112 to the back side 106 of the block 14. The slot 114 preferably defines opposed tapered edges 115 in the back face 106 (best illustrated in FIG. 6). In the illustrated embodiment, the channel 112 has a base surface 116 which is substantially parallel to the front face 104. In this embodiment, the slot 114 preferably opens to the channel 112 at an apex. The channel 112 defines a pair of bearing surfaces 118, 120, for a purpose discussed below. The opening to the slot 114 is preferably between the two bearing surfaces 118, 120.

The blocks 14 are preferably pre-cast concrete. As is conventional with blocks for earth retaining walls, the illustrated embodiment of the block 16 includes matingly conformable top and bottom surfaces 108, 110. In the illustrated embodiment, the top surface 108 defines a raised portion and a recessed portion. The opposing bottom 110 likewise defines a recess portion and an extended portion. The recess portion in the top 108 opposes the extended portion in the bottom 110. The raised portion in the top surface 108 opposes the recess portion in the bottom surface. When blocks 14 are stacked in tiers 80, 82, the recessed portion of blocks in the lower tier 80 receive the respective extended portion of the blocks 14 in the upper tier 82. Similarly, the raised portions in the lower tier 80 are received in the respective recesses of the upper tier 82. In this way, the blocks 14 in vertically adjacent tiers 80, 82 are matingly engaged.

Figure 6:
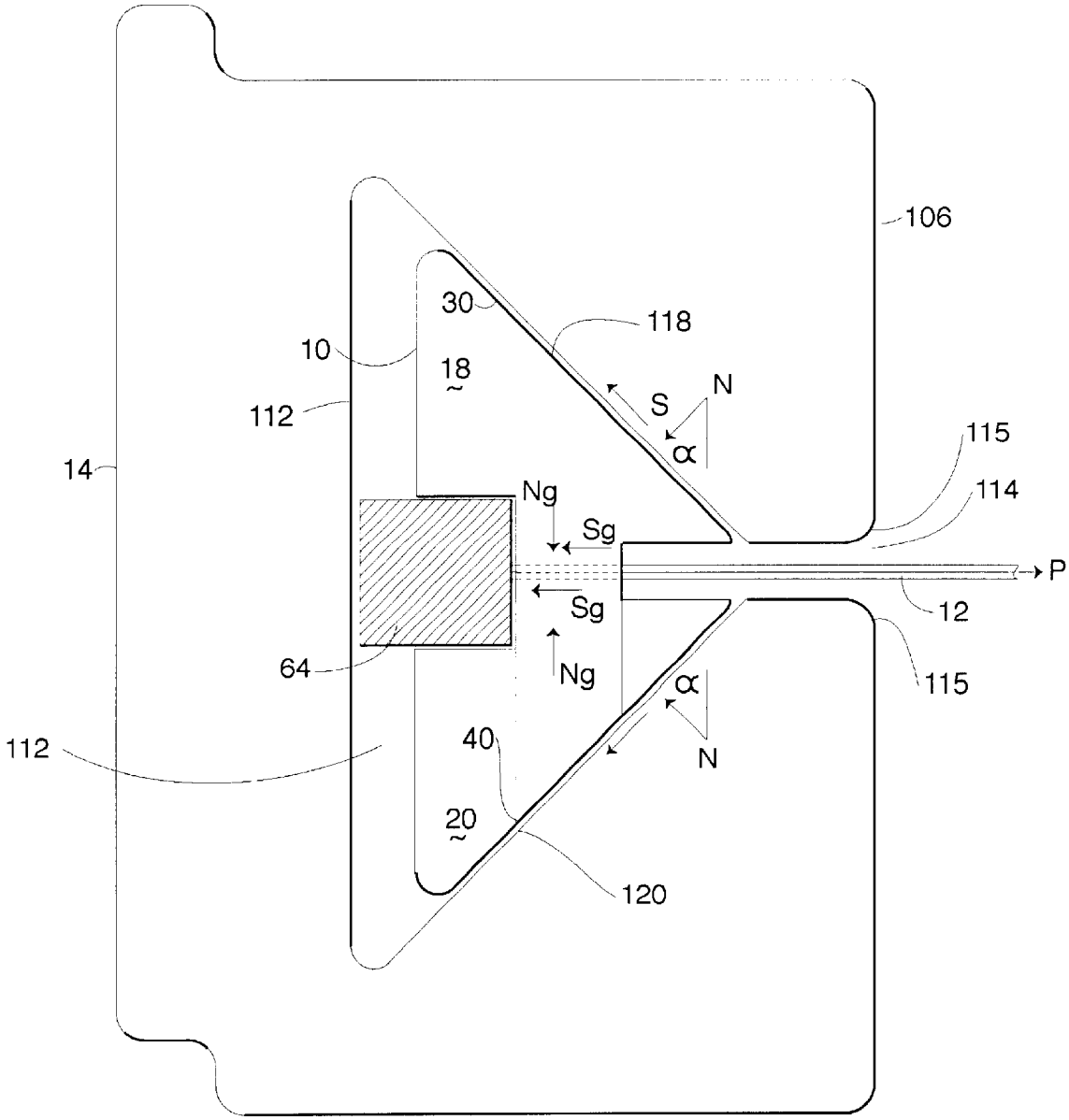
FIG. 6 illustrates a design concept for the present invention.

With reference to FIG. 6, a design for the connector 10 may be described as the combination of the frictional loading between the block 14 and the connector 10 and the pull out frictional loading of the reinforcement grid 12 and the connector 10. Both components must exceed the pull out force P on the reinforcement grid 12. This is described as follows, where:

$P_1$ is the pull-out loading for the reinforcement grid 12, which equals the resisting force of the friction between the connector 10 and the bearing surfaces 118, 120 in the block 14.

N is the normal loading between the bearing surface 118, 120 and the surfaces 30, 40 of the connector 10.

$N_g$ is the loading on the reinforcement grid 12 from the loading N.

S is the friction loading between the reinforcement grid 12 and the bearing surfaces 118, 120.

$S_g$ is the friction loading between the reinforcement grid 12 and the connector 10.

$\alpha$ a is the angle between the normal load N and a perpendicular line to the reinforcement grid 12, which is one-half the angle defined by the bearing surfaces 118, 120.

$\phi$ is the friction angle between the bearing surface 118, 120 and the surfaces 30, 40 of the connector 10. This angle controls the self-locking attribute of the apparatus of the present invention.

$\delta$ is the apparent friction angle of the connector 10 to the reinforcement grid interface.

The frictional loading between the block 14 and the connector 10 is described by the following equations:

$$P_1=2N \sin \alpha+2S \cos \alpha \quad \text{(Eq. 1)}$$

$$S=N \tan \phi \quad \text{(Eq. 2)}$$

Accordingly, $$P_1=2N (\sin \alpha+\tan \phi \cos \alpha) \quad \text{(Eq. 3)}$$

The mobilized peak pull-out resistance is represented by the frictional load between the reinforcement grid 12 and the bearing surfaces 118, 120 of the channel 112 and between the reinforcement grid 12 and the connector 10. The tensile loading on the reinforcement grid 12 accordingly is resisted by four surfaces of frictional loading.

The pull-out resistance of the reinforcement grid 12 within the connector 10 is described by the normal load applying friction in the horizontal direction, which opposes the pull-out force of the reinforcement grid:

$$N_g=N \cos \alpha-S \sin \alpha \quad \text{(Eq. 4)}$$

$$P_2=2S_g \quad \text{(Eq. 5)}$$

$$P_2=2N_g \tan \delta \quad \text{(Eq. 6)}$$

Combining Eq. 4 and 6, $$P_2=2(N \cos \alpha-N \tan \phi \sin \alpha) \tan \delta \quad \text{(Eq. 7)}$$

or simplified, $$P_2=2N \tan \delta (\cos \alpha-\tan \phi \sin \alpha) \quad \text{(Eq. 8)}$$

In evaluating failure criterion, the connector 10 within the channel must have sufficient pull-out resistance (i.e., the reinforcement grid 12 must not pull out of the connector 10):

$$P_2 \geqq P_1$$

$$\tan \delta \geq \frac{\sin\alpha + \tan\phi\cos\alpha}{\cos\alpha - \tan\phi\sin\alpha} \quad \text{(Eq. 9)}$$

$$\tan \delta \geq \frac{\tan\alpha + \tan\phi}{1 - \tan\alpha\tan\phi} \quad \text{(Eq. 10)}$$

$$\tan \delta \geqq \tan (\alpha+\phi) \quad \text{(Eq. 11)}$$

Accordingly, $$\delta \geqq (\alpha+\phi) \quad \text{(Eq. 12)}$$

The reinforcement grid 12 is locked within the connector 10 through the interlocking pins 22, and the connector 10 achieves ultimate strength bearing against the bearing surfaces as long as the pins 22 are sufficiently strong. Pull-out failure is not anticipated, and thus, Eq. 12 that $\delta \geqq (\phi+\alpha)$ holds.

With reference to FIGS. 1, 3, and 4, Eq. 12 that the connector 10 is used in the wall 16 constructed by placing at least two stacked tiers 80, 82 of the blocks 14 side-by-side to define the length of the wall. The blocks 14 are aligned so the channels 112 extend longitudinally through the wall 16 with the slot 114 extending towards the back side of the wall.

The connector 10 assembles by sandwiching a portion of one of the soil-reinforcement grids 12 between the first member 18 and the second member 20. The pins 22 align with the openings 50 which slidingly receive the pins. The pins 22 extend through the respective apertures 76 in the grids 12. The enlarged portion 64 of the grid 12 is received in the channel 62. The walls 28, 58 define a stop that bears against the enlarged portion 64. The assembled connector 10 with the soil-reinforcement grid 12 sliding is received in the channel 112. A portion of the soil-reinforcement grid 12 is slidingly received within the slot 114 and extends laterally of the wall 16. The lateral portion of the grid 12 is covered with backfill 70. The tensile loading on the grid 12 causes the connector 10 to move into bearing contact with the bearing surfaces of the channel. The bearing surfaces 30, 40 of the first member 18 and the second member 20 engage the bearing surfaces 118, 120 and lock the grid 12 to the block 14 and thus to the wall 16. The connector 10, being engaged to the soil-reinforcement grid 12 that is loaded by the backfill 70, mechanically engages the two bearing surfaces of the channel such that the tensile loading is distributed across the block.

Figure 5:
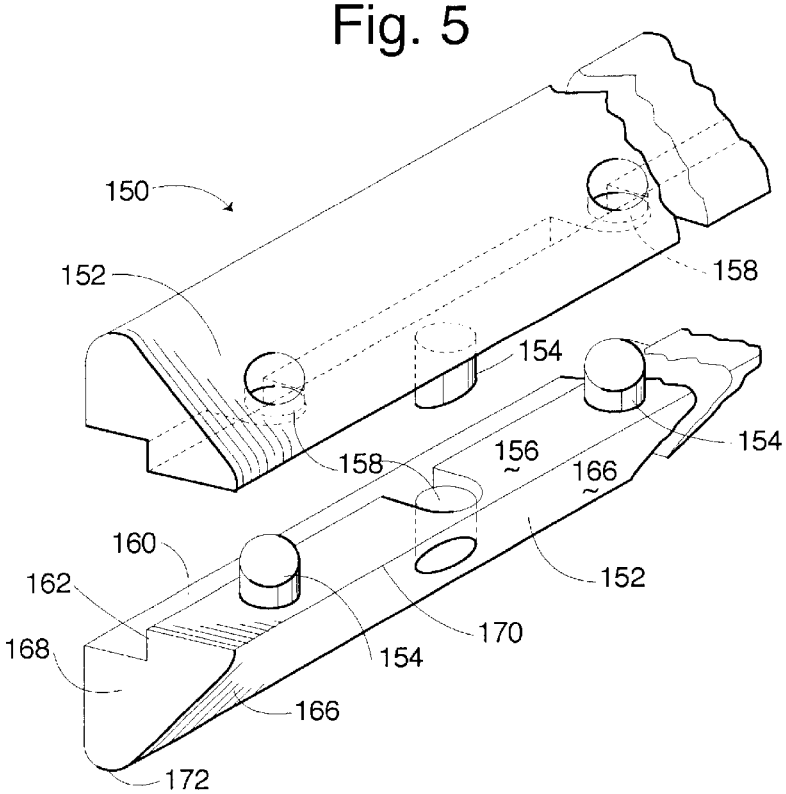
FIG. 5 illustrates an exploded perspective view of an alternate embodiment of the connector illustrated in FIG. 1 for engaging open aperture soil reinforcement grids to blocks in earth retaining walls.

FIG. 5 illustrates an exploded perspective view of an alternate embodiment 150 of the connector 10 for engaging open aperture soil reinforcement grids 12 to blocks 14 in earth retaining walls 16, according to the present invention. The connector 150 assembles from a two members 152. Each member 152 defines a plurality of pins 154 extending from a first field 156 and alternating openings 158. The pins 154 and openings 158 are spaced-apart along the longitudinal length of the member 150. The member 150 also defines a second field 160 lateral of the pins 154 and openings 158 along its longitudinal length. The second field 160 is recessed relative to the first field 156. The transition between the first field 156 and the second field 160 defines a wall 162 which forms the stop for the enlarged portion 64 of the grid 12. The member 150 defines an exterior bearing surface 166, a back side 168, and a front edge 170. An edge 172 between the bearing surface 166 and the back side 168 is preferably radiused. The front edge 170 is partially radiused to define a tapered edge with the first field 156. The connector 150 assembles by slidingly receiving the respective pins 154 of one member 152 within the openings 158 of a second one of the members 152. While the use of the members 152 has longitudinally extending overlap portions at the opposing distal ends of the connector 150, the common member requires one mold to manufacture rather than two different molds.

While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. A connector for being received within a channel defined in blocks stacked side by side in tiers to define an earth retaining wall and being engaged to soil reinforcing grids extending through slots from the channels outwardly of the blocks, to transfer tensile loading imposed by backfill on the soil reinforcing grids to the earth retaining wall, comprising:

an elongate first member having a plurality of pins spaced-apart along the longitudinal length thereof and each pin extending in a first direction from a first side of the first member; and an elongate second member having a plurality of openings spaced-apart along the longitudinal length thereof for aligning with the pins, whereby the first member and the second member matingly connect by slidingly receiving the aligned pins within the openings while sandwiching therebetween a soil reinforcement grid having open apertures through which the pins extend, the assembled connector received in the channel for securing the soil reinforcement grid thereto.

2. The connector as recited in claim 1, wherein the first member defines a recessed field lateral of the pins along the longitudinal length thereof; and wherein the second member defines a recessed field lateral of the openings along the longitudinal length thereof, whereby the respective recessed fields define opposing walls of a channel in the connector for receiving an enlarged portion of the soil reinforcement grid.

3. The connector as recited in claim 1, wherein the first member defines a plurality of second openings along the longitudinal length thereof and the second member defines a plurality of second pins along the longitudinal length thereof, the second pins slidingly received in the second openings when matingly joining the first and the second members.

4. The connector as recited in claim 1, wherein the connector defines exterior bearing surfaces that conform in cross-sectional shape to bearing surfaces of the channel within the block.

5. The connector as recited in claim 1, wherein the connector is substantially triangular in cross-sectional view.

6. The connector as recited in claim 5, wherein adjacent exterior surfaces thereof define apexes that are radiused.

7. The connector as recited in claim 5, wherein the shape of the connector in cross-sectional view is substantially equilateral.

8. The connector as recited in claim 7, wherein adjacent exterior surfaces thereof define apexes that are radiused.

9. A connector for being received within a channel defined in blocks stacked side by side in tiers to define an earth retaining wall and being engaged to soil reinforcing grids to transfer loading imposed by backfill on the soil reinforcing grids to the earth retaining wall, comprising:

an elongate first member having a plurality of pins spaced-apart along the longitudinal length thereof and each pin extending in a first direction from a first field defined on a first side of the elongate member with a second field recessed laterally of the first field; and an elongate second member having a plurality of openings spaced-apart along the longitudinal length thereof in a first field thereof for aligning with the pins and a second field therein recessed laterally of the first field of the second member, whereby the first member and the second member matingly connect by slidingly receiving the aligned pins within the openings while sandwiching therebetween a soil reinforcement grid having open apertures for receiving the pins therethrough with the recessed second fields defining opposing walls of a channel for receiving an enlarged portion of the soil reinforcement grid.

10. The connector as recited in claim 9, wherein the first member defines a plurality of second openings along the longitudinal length thereof and the second member defines a plurality of second pins along the longitudinal length thereof, the second pins slidingly received in the second openings when matingly joining the first and the second members.

11. The connector as recited in claim 9, wherein the connector defines exterior bearing surfaces that conform in cross-sectional shape to bearing surfaces of the channel within the block.

12. The connector as recited in claim 9, wherein the connector is substantially triangular in cross-sectional view.

13. The connector as recited in claim 12, wherein adjacent exterior surfaces thereof define apexes that are radiused.

14. The connector as recited in claim 13, wherein the shape of the connector in cross-sectional view is substantially equilateral.

15. The connector as recited in claim 14, wherein adjacent exterior surfaces thereof define apexes that are radiused.

16. An earth retaining wall, comprising:

at least two stacked tiers of blocks placed side by side, each of the blocks defining a channel extending between opposing sides, the channel defining at least two adjacent bearing surfaces and an opening between the bearing surfaces to a slot extending laterally from the channel to a back side of the block;

an elongate connector conforming in cross-sectional shape at least relative to the pair of adjacent bearing surfaces defined in the channel, received within the channel with an apex thereof adjacent the opening of the channel to the slot, comprising:

an elongate first member having a plurality of pins spaced-apart along the longitudinal length thereof and each pin extending in a first direction from a first side of the first member; and an elongate second member having a plurality of openings spaced-apart along the longitudinal length thereof for aligning with the pins, whereby the first member and the second member matingly connect by slidingly engaging the aligned pins within the openings; and a soil reinforcement grid having a plurality of apertures with a portion thereof sandwiched between the first and the second members and the pins extending through respective apertures, a portion of the soil reinforcement grid extending from the slot laterally of the blocks, whereby the connector, being engaged to the soil reinforcement grid and received in the channel with the soil reinforcement grid extending through the slot laterally away from the blocks and the extended portion thereof loaded by backfill, mechanically engages the bearing surfaces of the channel to distribute the tensile loading across the wall.

17. The earth retaining wall as recited in claim 16, wherein the first member defines a recessed field lateral of the pins along the longitudinal length thereof; and wherein the second member defines a recessed field lateral of the openings along the longitudinal length thereof, whereby the respective recessed fields define opposing walls of a channel in the connector for receiving an enlarged portion of the soil reinforcement grid.

18. The earth retaining wall as recited in claim 16, wherein the first member defines a plurality of second openings along the longitudinal length thereof and the second member defines a plurality of second pins along the longitudinal length thereof, the second pins slidingly received in the second openings when matingly joining the first and the second members.

19. The earth retaining wall as recited in claim 18, wherein the slot in the back side of the block defines arcuately tapered edge surfaces between the slot and the back side.

20. The earth retaining wall as recited in claim 18, wherein the slot in the back side of the block defines arcuately tapered edge surfaces between the slot and the back side.

21. The earth retaining wall as recited in claim 18, wherein the slot opens to the channel at an apex thereof.

22. The earth retaining wall as recited in claim 18, wherein the connector defines textured exterior surfaces.

23. The earth retaining wall as recited in claim 18, wherein opposing upper and lower surfaces of the blocks define opposed mating surfaces for interlocking adjacent tiers of blocks.

24. The earth retaining wall as recited in claim 16, wherein the connector defines exterior bearing surfaces that conform in cross-sectional shape to bearing surfaces of the channel within the block.

25. The earth retaining wall as recited in claim 16, wherein:

the connector is substantially triangular in cross-sectional view; and the channel defines a triangular shape in cross-sectional view for conformingly receiving the connector.

26. The earth retaining wall as recited in claim 25, wherein adjacent exterior surfaces of the first and the second members define an apex that is radiused.

27. The earth retaining wall as recited in claim 25, wherein the connector in cross-sectional view is substantially equilateral.

28. The earth retaining wall as recited in claim 27, wherein the apexes of the connector are radiused.

29. The earth retaining wall as recited in claim 27, wherein the slot opens to the channel at an apex thereof.

30. A method of constructing an earth retaining wall, comprising the steps of:

(a) placing at least two stacked tiers of blocks side by side to define a length of a wall, each of the blocks defining a channel extending between opposing sides thereof, the channel defining at least two adjacent bearing surfaces and opening between the bearing surfaces to a slot extending laterally from the channel to a back side of the block;

(b) sandwiching a portion of a soil-reinforcement grid between an elongate first member and an elongate second member that matingly engage together to define a connector, the first member having a plurality of pins spaced-apart along the longitudinal length thereof and each pin extending in a first direction therefrom, the second member having a plurality of openings spaced-apart along the longitudinal length thereof for aligning with the pins, and the soil-reinforcement grid having a plurality of apertures defined therein for being received by the pins while sandwiched between the first and the second members;

(c) sliding the connector with the soil-reinforcement grid along the channel with a portion of the soil-reinforcement grid slidingly received within the slot and extending laterally of the wall; and (d) covering the portion of the soil-reinforcement grid lateral of the wall with backfill, whereby the connector, being engaged to the soil-reinforcement grid that is loaded by the backfill, mechanically engages the two bearing surfaces of the channel such that the tensile loading is distributed across the block.

31. The method as recited in claim 30, further comprising the step of providing each block with opposing upper and lower surfaces with matingly engageable features for interlocking adjacent tiers of blocks.

32. The method as recited in claim 30, further comprising the step of providing a textured exterior surface to the connector.

* * * * *